United States Patent [19]

Iwabuchi

[11] 3,981,035

[45] Sept. 21, 1976

[54] COLLAPSIBLE HIGH SPEED BOAT

[75] Inventor: Arata Iwabuchi, Tokyo, Japan

[73] Assignee: Mitsui Petrochemical Industries, Ltd., Tokyo, Japan

[22] Filed: May 20, 1975

[21] Appl. No.: 579,144

[30] Foreign Application Priority Data

May 21, 1974 Japan ..... 49-57060

[52] U.S. Cl. ..... 9/2 C

[51] Int. Cl.[2] ..... B63B 7/04

[58] Field of Search ..... 9/2 R, 2 C, 2 F, 2 S

[56] References Cited

UNITED STATES PATENTS

| | | | |
|---|---|---|---|
| 1,062,181 | 5/1913 | Nyboe | 9/2 C |
| 1,114,996 | 10/1914 | Lawson | 9/2 C |
| 2,271,338 | 1/1942 | Hamlin, Jr. | 9/2 C |

FOREIGN PATENTS OR APPLICATIONS

| | | | |
|---|---|---|---|
| 928,940 | 12/1947 | France | 9/2 C |
| 47,194 | 4/1929 | Norway | 9/2 C |

*Primary Examiner*—Trygve M. Blix
*Assistant Examiner*—Stuart M. Goldstein
*Attorney, Agent, or Firm*—James E. Nilles

[57] ABSTRACT

A collapsible or foldable high speed boat including a hull structure having no frames. The boat comprises a plurality of substantially triangular hinged plates joined in such a manner as to be waterproof and defining a hull structure such as that of a high speed boat. The hull structure includes a plurality of inflection points, these points being at the foremost end on the gunwale line of the stem, at the foremost end of the keel, at the widest chine line at the center portion of the hull, at the widest gunwale portion at the outermost end on the keel of the stern, and at the outermost end of the gunwale line of the stern. These inflection points can be respectively joined by lines which form substantially triangular planes. These planes define the location and shape of the various hinged plates defining the hull structure. Thus the hinged plates are arranged in a relationship formed by joining in line plural inflection points on the hull lines.

6 Claims, 10 Drawing Figures

COLLAPSIBLE HIGH SPEED BOAT

The present invention relates to a high speed boat, more particularly the hull structure thereof having no frames.

Conventional boats usually built by assembling frames to a keel and attaching outside members to thus assembled body have such drawbacks that too many hull materials must be used to build a boat and that efficiency of building operation is low.

The present invention is intended to eliminate the above-mentioned drawbacks by building the hull with a plurality of substantially triangular plates without using frames so as to improve efficiency of building operation.

The present invention is also intended to provide a complete hull structure for a high speed boat comprising curved plates of fan-shape at the gunwale portions adjacent to the widest central portion of the hull built by a plurality of substantially triangular plates, each of said curved plates binding in streamline the back- and front-gunwale lines abutting to that of said curved plate.

The present invention is further intended to provide a foldable boat.

Among conventional foldable boats there are known hull structures having their outside members made of rubber, rubber-coated cloth or aluminium plates and having the hull itself built with thick plates.

As shown in FIGS. 1(a), 1(b) and FIGS. 2(a), 2(b), this conventional foldable boat built with thick plates is typed by a towed barge or a pontoon such as a military landing craft comprising a triangular wave-breaking member or members attached to the front portion or back and front portions of the box-shaped hull, which is quite different from that of the high speed boat. The boat having this hull structure found in the towed barge or the pontoon is subjected to high propulsive resistance such as frictional, wave making, eddy or splash one and is therefore limited in the use thereof, that is, the boat is only used as a floating body or an extremely low speed one, thus making it impossible to expect the boat of this kind to have the same sailing performance as a ship or boat would have.

On the other hand, there can also be found a rubber boat of air-pouring type, a foldable boat comprising attaching rubber-coated cloth, water-proofed canvas or the like to wooden or metal frames, and an aluminium boat formed by bending aluminium thin plates loosely so as to have a hull approximate to that of the high speed boat. However, these boats are so poor in strength in their structures and outside members that unstable deformation due to waves during their sailing and damages due to floating or projecting materials tend to be occurred to their hull structures and their outside members, respectively, thus eventually causing them to be sunk into the water, which can be said to be dangerous to those who are on them. Therefore, however alike they may be in their hull structures to that of the high speed boat, they are limited in their use to low speed range.

Considering these points, the present invention is intended to provide a foldable boat which is usable also as a yacht wherein the hull structure comprises foldably connecting a plurality of substantially triangular plates with one another to improve its durability and the hull shape is also improved to have the same sailing performance as the high speed boat would have.

Other objects and features of the present invention will be apparent from the following description with reference to the accompanying drawings, in which.

There will be now described the basic principle of the present invention.

Figure 2:
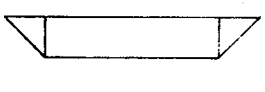
FIG. 2(a) is a plan view of the hull of other conventional foldable boat.
FIG. 2(b) is a side view of the same hull as shown in FIG. 2(a)
Figure 1:
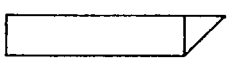
FIG. 1(a) is a plan view of the hull of a conventional foldable boat.
FIG. 1(b) is a side view of the same hull as shown in FIG. 1(a)
Figure 2:
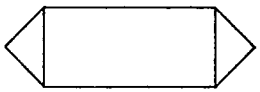
Figure 1:
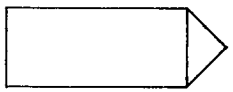
Figure 3:
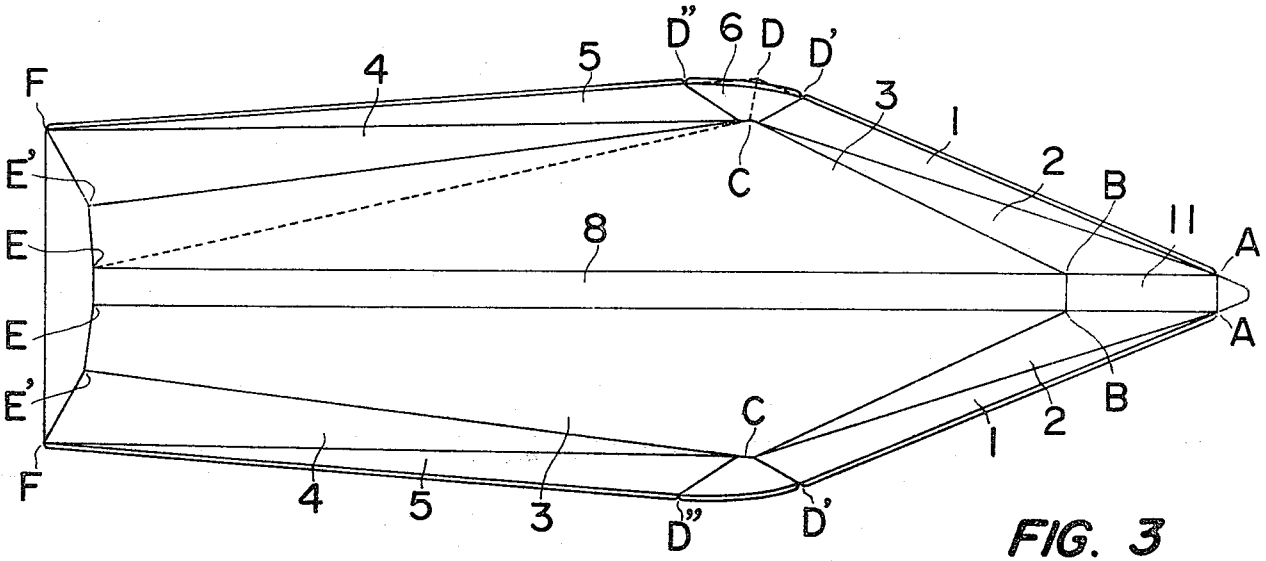
FIG. 3 is a plan view of hull lines showing the basic principle of the present invention.
Figure 4:
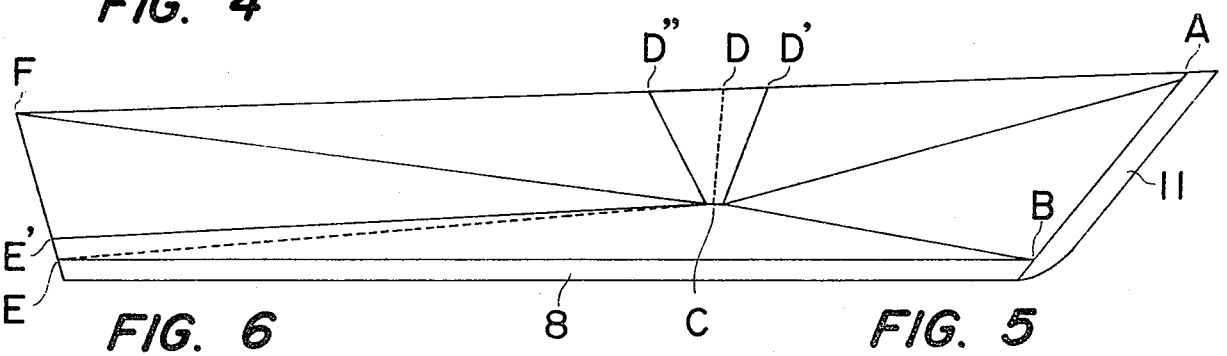
FIG. 4 is a side view of the same hull lines as shown in FIG. 3.
Figure 5:
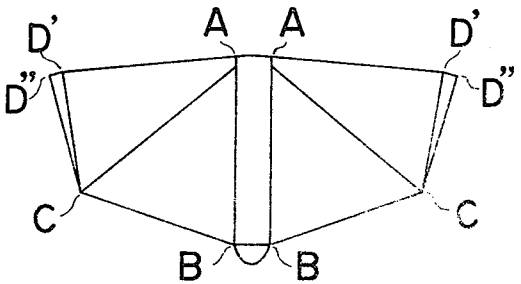
FIG. 5 is a view of the hull lines viewed from the stem thereof.
Figure 6:
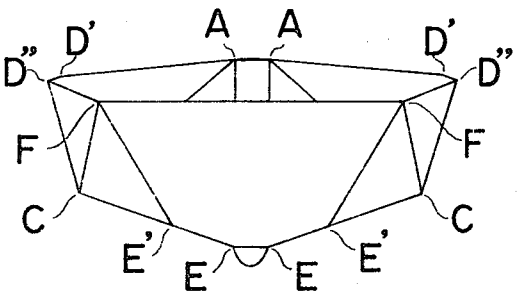
FIG. 6 is a view of the hull lines viewed from the stern thereof.

The hull of a high speed boat has a plurality of inflection points of the paraboric curve on the hull lines, as shown in FIGS. 3 and 4.

Typical inflection points on the hull lines are summed up as point A at the foremost end on the gunwale line of the stem, point B at the foremost end on the keel, point C at the widest chine line at the central portion of the hull, point D at the widest gunwale portion, point E at the outermost end on the keel of the stern and point F at the outermost end on the gunwale line of the stern. These inflection points are respectively joined to the corresponding ones with lines $\overline{AB}$, $\overline{AC}$, $\overline{AD}$, $\overline{BC}$, $\overline{CD}$, $\overline{CE}$ and $\overline{CF}$ to form substantially triangular planes $\Delta ABC$, $\Delta ACD$, $\Delta CDF$, $\Delta CEF$ and $\Delta BCE$. These triangular planes are combined with one another to form the half hull of a boat.

For the purpose of further correcting the gunwale line, the inflection point D adjacent to the central portion of the hull are divided to two inflection points D′ and D″, that is, $\Delta ADC$ is divided to $\Delta ACD'$ and $\Delta CDD'$, and $\Delta CDF$ to $\Delta CDD''$ and $\Delta CD''F$, respectively, $\Delta CDD'$ and $\Delta CDD''$ are combined with each other so as to form the line $\overline{D'DD''}$, which joins the gunwale line $\overline{AD'}$ to the one $\overline{D''F}$, as a slightly streamlined arc $\widehat{D'D''}$ and the substantially triangular plane $\Delta CD'D''$ as a curved plate of fan-shape.

For the purpose of improving stability of the hull, there is further provided a point E′ at the outermost end of the hull bottom, thus permitting the substantially triangular plane $\Delta CEF$ to be formed by $\Delta CEE'$ and $\Delta CE'F$.

The apex A of $\Delta ACD'$ is acute and becomes thin and poor in strength. Therefore, it is necessary also from manufacturing operation that this acute portion is compensated in thickness in such a way that it is cut to have enough thickness.

Figure 7:
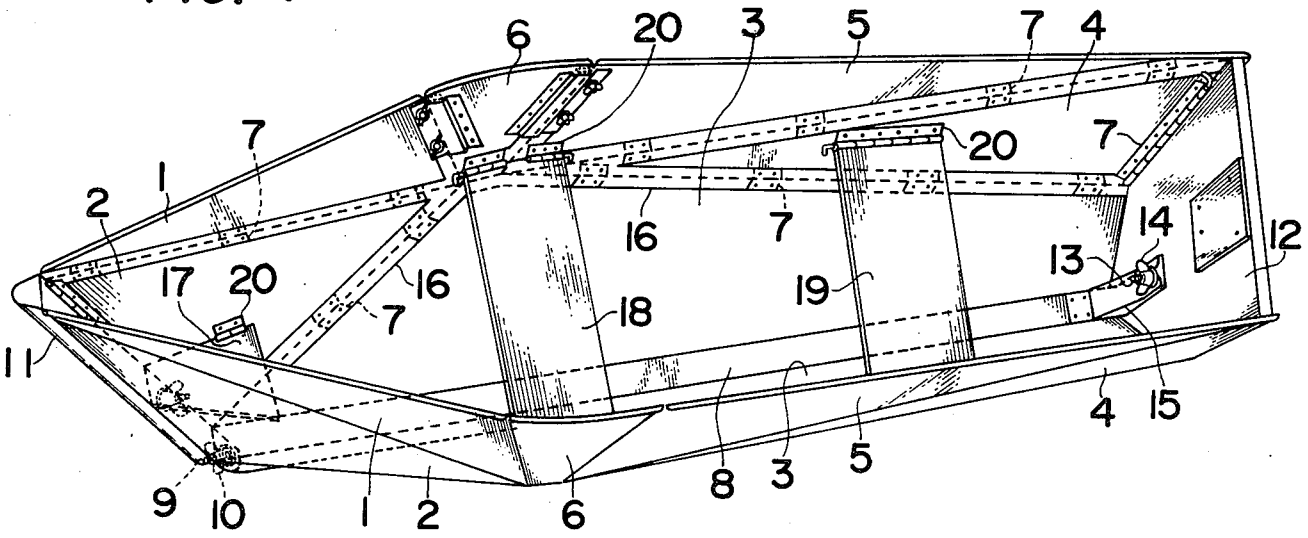
FIG. 7 is a perspective view showing an embodiment of the present invention.

There will be now described an embodiment of the present invention with reference to FIG. 7.

Each of substantially triangular plates $\Delta ACD'$ (1), $\Delta ABC$ (2), BEE′C (3), $\Delta CE'F$ (4), $\Delta CD''F$ (5) and $\Delta CD'D''$ (6) comprises adhering water-proofed plywoods to have a proper thickness, for example, of 25 mm. Sides AC, BC, CE', CF, CD', CD'' of these triangular plates 1, 2, 3, 4, 5, 6 are foldably connected with one another by means of freely bent metal fittings 7 such as hinges. Sides AB, BE of triangular plates 2, 3 are also connected to a keel 8 and a stem 11 by means of freely bent metal fittings (not shown).

A stem 11 is detachably attached to the stem portion by screwing a nut 10 onto a threaded pin 9 projected from the keel 8 and a transom 12 also detachably to the stern portion through a bracket 15, which is attached to the keel 8, by screwing a nut 14 onto a threaded pin 13 projected from the transom 12.

To connection portions between sides of triangular plates 1, 2, 3, 4, 5, 6, between these sides and the keel 8, and between these sides and the stem 11 are attached water-tight materials 16 such as water-proof rubber so as to provide water-tightness to the hull structure.

Seat plates 17, 18, 19 are attached to the hull by means of connection means 20 so as to also reinforce the hull in the lateral direction thereof.

Widths of the keel 8 and the stem 11 are appropriately increased or decreased according to that of each of triangular plates 1, 2, 3, 4, 5, 6. For example, when each of these plates is 25 mm thick, they will have a width of 90 mm.

To the keel 8 are detachably attached sailing means such as a mast and center boards (not shown).

To the transom 12 is also detachably attached a Rudder (not shown).

The inner circumference of the transom 12 and the plates adjacent to the inner circumference are covered by a water-proof sheet (not shown).

Figure 8:
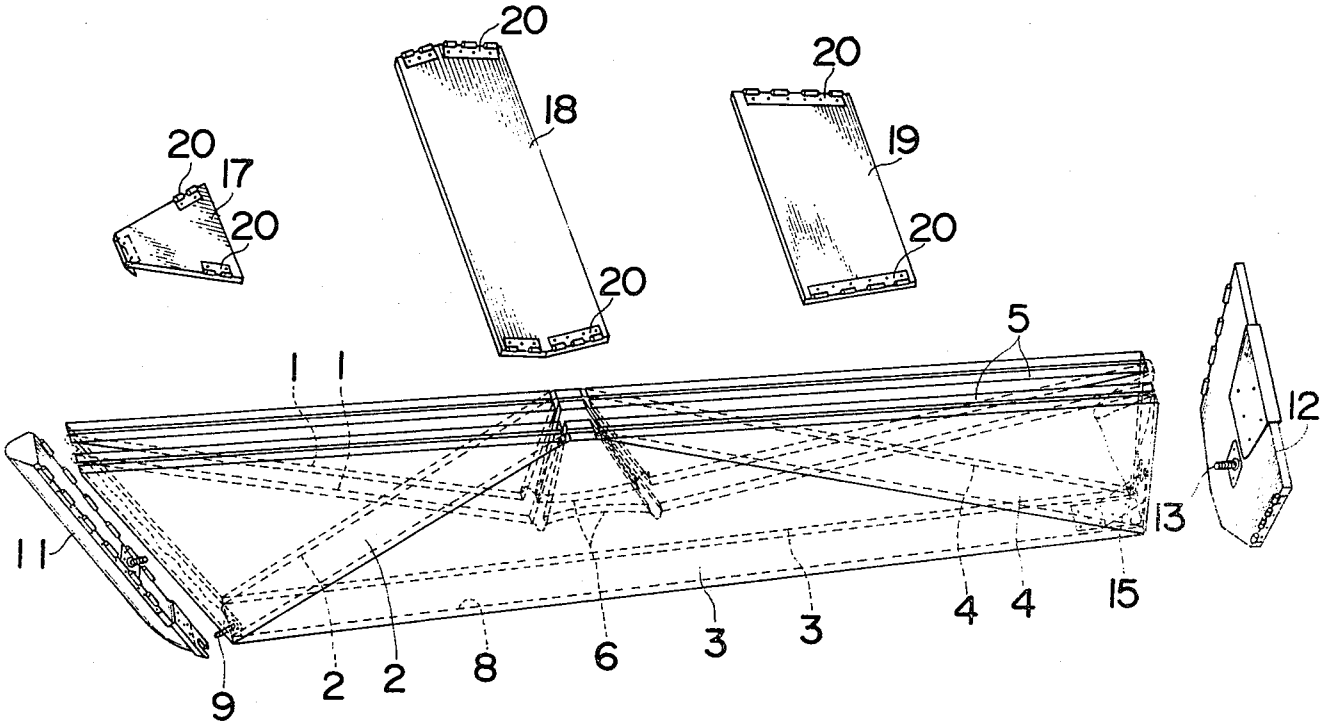
FIG. 8 is a perspective view showing the embodiment folded.

The hull thus assembled can be folded as shown in FIG. 8. The stem 11, the transom 12 and seat plates 17, 18, 19 are removed from the hull; ΔACD' (1), ΔCD'D'' (6) and ΔCD''F (5) are inwardly folded along the lines joining the inflection points (A), (C), (F), respectively, to leave the outer edge lines AC, CF of ΔABC (2) and ΔCE'F (4) a continued straight line; and ΔABC (2) and BEE'C (3) are folded inwardly along the lines AB and BE. The hull of the boat can be thus folded in a flat shape.

Accordingly, the present invention provides such advantages that: the hull can be assembled by a plurality of substantially triangular plates without using frames so as to form a hull shape suitable for use as a high speed boat; the hull shape can be modified because the gunwale portion adjacent to the widest chine line of the hull is formed by a curved plate of fan-shape; and the hull can be folded in a flat shape.

What is claimed is:

1. A collapsible high speed boat including a hull structure comprising a plurality of substantially triangular plates formed by joining in line plural inflection points on the hull, said hull structure including back and front gunwale lines and curved fan-shaped plates at gunwale portions adjacent to central portions of the hull, each of said curved fan-shaped plates joining the back and front gunwale lines in streamline relation, and a rigid keel extending from a stem portion of the hull to a stern portion of the hull in order to prevent the hull structure from being bent in the longitudinal direction thereof.

2. A collapsible high speed boat including a hull structure comprising a plurality of substantially triangular plates formed by joining in line plural inflection points on the hull, said hull structure including back and front gunwale lines and curved fan-shaped plates at gunwale portions adjacent to central portions of the hull, each of said curved fan-shaped plates joining the back and front gunwale lines in streamline relation, and a stem mounted on a stem portion of the hull.

3. A collapsible high speed boat including a hull structure comprising a plurality of substantially triangular plates formed by joining in line plural inflection points on the hull, said hull structure including back and front gunwale lines and curved fan-shaped plates at gunwale portions adjacent to central portions of the hull, each of said curved fan-shaped plates joining the back and front gunwale lines in streamline relation, and said hull including a widest portion adjacent to a central portion of the hull, and a stem portion of the hull and a stern portion of the hull being made asymmetrically to each other and connected with each other by curved plates of fan-shape positioned at the widest portion of the hull.

4. A collapsible high speed boat including a hull structure comprising a plurality of substantially triangular plates formed by joining in line plural inflection points on the hull structure, curved plates of fan-shape at the widest portion of the hull adjacent to the central portion of the hull, each of said curved plates joining in streamline the back and front gunwale lines abutting to that of said curved plate, each side of said triangular plates being water-tightly and foldably connected with the corresponding one thereof and each of said triangular plates being foldable along the connected side, a keel extending from a stem portion of the hull to a stern portion of the hull in order to prevent the hull from being bent in the longitudinal direction thereof, and a stem mounted on said stem portion, said stem portion of the hull and said stern portion of the hull being made asymmetrically to each other and connected with each other by said curved plates.

5. A foldable high speed boat including a rigid hull structure comprised of a plurality of hingedly joined substantially rigid triangular plates and a rigid keel, at least two of said triangular plates being joined to said keel and on opposite sides of said keel and wherein said hull structure includes a plurality of inflection points, each of said triangular plates lying in a plane defined by lines joining said inflection points, and a pair of rigid curved fan-shaped plates at the widest portion of the hull adjacent to the central portion of the hull, each of said fan-shaped plates hingedly connected between at least two of said triangularly shaped plates.

6. A collapsible high speed boat including a hull structure comprising a plurality of substantially triangular plates formed by joining in line plural inflection points on the hull, said triangular plates each being water-tightly and foldably connected along at least one side to an adjacent triangular plate and each of said triangular plates being foldable along the connected side, said hull including a widest portion adjacent to a central portion of the hull, a stem portion of the hull and a stern portion of the hull being made asymmetrically to each other and connected with each other by curved plates of fan-shape positioned at the widest portion of the hull.

* * * * *